US010385484B1

(12) United States Patent
Wyrick et al.

(10) Patent No.: US 10,385,484 B1
(45) Date of Patent: Aug. 20, 2019

(54) FACE MASK WITH EAR LOOPS AND A PROCESS FOR MAKING THE SAME

(71) Applicant: Flynt Amtex, Inc., Burlington, NC (US)

(72) Inventors: Beamon McKinley Wyrick, Graham, NC (US); John Anthony Kranaskas, Greensboro, NC (US)

(73) Assignee: Flynt Amtex, Inc., Burlington, NC (US)

( * ) Notice: Subject to any disclaimer, the term of this patent is extended or adjusted under 35 U.S.C. 154(b) by 563 days.

(21) Appl. No.: 15/134,707

(22) Filed: Apr. 21, 2016

Related U.S. Application Data

(60) Provisional application No. 62/233,621, filed on Sep. 28, 2015.

(51) Int. Cl.
*A41D 13/11* (2006.01)
*D04B 1/22* (2006.01)
*D04B 9/44* (2006.01)

(52) U.S. Cl.
CPC ..... *D04B 1/225* (2013.01); *A41D 13/1161* (2013.01); *D04B 9/44* (2013.01)

(58) Field of Classification Search
USPC ..... 128/863
See application file for complete search history.

(56) References Cited

U.S. PATENT DOCUMENTS

| | | | |
|---|---|---|---|
| 2,290,628 | A | 7/1942 | Alderfer |
| 4,541,696 | A | 9/1985 | Winger et al. |
| 4,802,473 | A | 2/1989 | Hubbard et al. |
| 4,941,470 | A | 7/1990 | Hubbard et al. |
| 5,600,973 | A | 2/1997 | Drisaldi |
| 5,803,077 | A | 9/1998 | Gazzara |
| 5,931,023 | A | 8/1999 | Brach et al. |
| 6,332,465 | B1 | 12/2001 | Zue et al. |
| 6,810,694 | B2 | 11/2004 | Wallis |
| 2013/0186414 | A1 | 7/2013 | Suzuki et al. |
| 2014/0209098 | A1 | 7/2014 | Dunn et al. |

OTHER PUBLICATIONS

Tex-Care Medical, Face Mask Ear Loop, known at least as early as Aug. 21, 2015, 1 pg.

*Primary Examiner* — Ophelia A Hawthorne
(74) *Attorney, Agent, or Firm* — Womble Bond Dickinson (US) LLP

(57) ABSTRACT

A circular knit fabric for use as ear loops on face masks. The fabric includes a circular knit tubular textile having loops containing at least one inelastic yarn and at least one separate elastic yarn. The finished tubular textile has a maximum relaxed width of less than about ¼ inches. In a relaxed state of the tubular textile, the at least one inelastic yarn has at least twice the length of the at least one elastic yarn. The textile has less than 16 loops per course such that the relaxed tubular textile produces a more pillowed structure for increased comfort and the capability for increased elongation.

23 Claims, 4 Drawing Sheets

FACE MASK WITH EAR LOOPS AND A PROCESS FOR MAKING THE SAME

TECHNICAL FIELD

The present disclosure relates to face masks of the type held on by elastic ear loops. More particularly, the present disclosure relates to textile products, and processes for making textile products, suitable for use as ear loops, and face masks having the same.

BACKGROUND

Health workers often choose, or are required, to wear disposable face masks for sanitary purposes to protect themselves and their patients from transfer of bodily fluid or other pathogens. The face masks are often a textile section worn over the mouth and nose to act as an air filter as air is breathed in and out by the wearer. Exemplary health workers that may benefit from these face masks include dental hygienists; dentists; and general practitioner or family doctors. Face masks may also be worn by others as a precautionary measure to limit the transfer of pathogens in areas of wide spread disease, such as the bird flu pandemic. Others may be advised to wear face masks when the individual has a suppressed immune system as the result of a medical condition or treatment thereof.

Face masks of the type having ear loops may also benefit workers and individuals outside of the healthcare industry. Manufacturing workers, such as those functioning in clean rooms, may use similar face masks to avoid contaminating the field with dust or debris. Yet others may use similar face masks to avoid inhaling potentially harmful particles during construction or renovation projects.

FIG. 1 shows an example of a face mask. The mask 100 may include a web 102, generally formed from a nonwoven material, configured to cover the nose and mouth of a user. The mask 100 may also include a pair of ear loops 104 attached to the web 102. Several methods have been used to join the ear loops 104 to the web 102 of the mask 100, including heat bonding the ear loops to opposing sides of the web.

Attempts have been made to create a circularly knit textile that can be cut to length for forming ear loops. A first attempt used separate inelastic and elastic yarn ends forming 16 loops in each course on a ⅝ inch cylinder. This first attempt produced a thinner stiffer product than proposed below. A second attempt knit a textile from polyester covered elastic yarn, which also failed to provide a desired level of bulk and comfort.

SUMMARY

For many workers, a face mask must be worn substantially continuously throughout the work day. This may require wearing the same mask, or repeatedly changing masks, throughout the day. In either case, there are clear benefits to making the mask as comfortable as possible, without compromising the safety aspects of the mask. One area where comfort may be improved is the contact between the ear loops and the user's ears. For a proper fit, the ear loops should be highly elastic. Elasticity allows the ear loops to be stretched around the ear and to recover, in order to hold a web of the mask in place. In some cases, the elastic force created by conventional ear loops can cause pressure on the back of the user's ears, eventually leading to discomfort.

Ear loops made from the textiles of the present disclosure provide sufficient elasticity for providing a tight fit for the mask while allowing the mask to be easily taken on and off around the ears. Importantly, ear loops made from the textiles of the present disclosure provide improved comfort by having a knit structure that results in a level of cushioning not previously available with ear loops.

The present disclosure includes a circular knit fabric used for face mask ear loops. The fabric includes a circular knit tubular textile having loops containing at least one inelastic yarn and at least one separate elastic yarn. The finished tubular textile has a maximum relaxed width of less than about ¼ inches. When the circular knit tubular textile is relaxed, the at least one inelastic yarn has at least twice the length of the at least one elastic yarn. The textile has less than 16 loops per course, and there is sufficient space between adjacent loops, such that the relaxed tubular textile produces a more pillowed structure for increased comfort.

The present disclosure also includes a face mask comprising a web configured to cover the nose and mouth of a user. The face mask also includes a pair of ear loops heat bonded to opposing sides of the web. Each ear loop comprises a circular knit tubular textile having loops containing at least one inelastic yarn and at least one elastic yarn. The finished tubular textile has a maximum relaxed width of less than about ¼ inches. When the circular knit tubular textile is relaxed, the at least one inelastic yarn has at least twice the length of the at least one elastic yarn. The textile has less than 16 loops per course, and there is sufficient space between adjacent loops, such that the relaxed tubular textile produces a pillowed structure for increased comfort.

Other embodiments include a method of making a small diameter tubular textile for use as ear loops on face masks. The method comprises stretching at least one elastic yarn with a first yarn tensioner to a length of at least two times a relaxed length thereof. The method next includes feeding the stretched elastic yarn and at least one inelastic yarn to a cylinder of a circular knitting machine, the cylinder being less than 1 inch in diameter. The tubular textile is then knit from the at least one elastic yarn and the at least one inelastic yarn.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
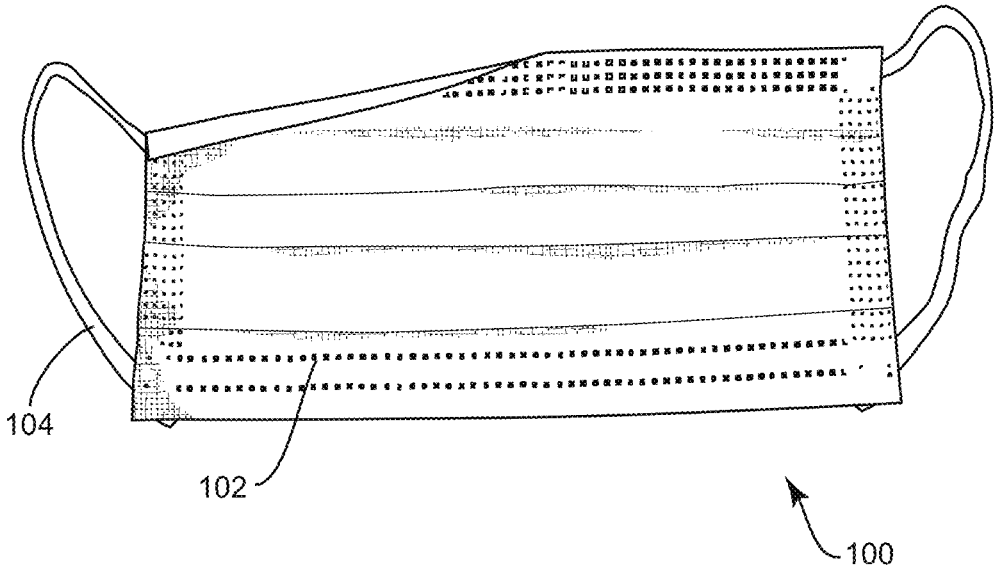
FIG. 1 is a front view of a face mask having ear loops.
Figure 2:
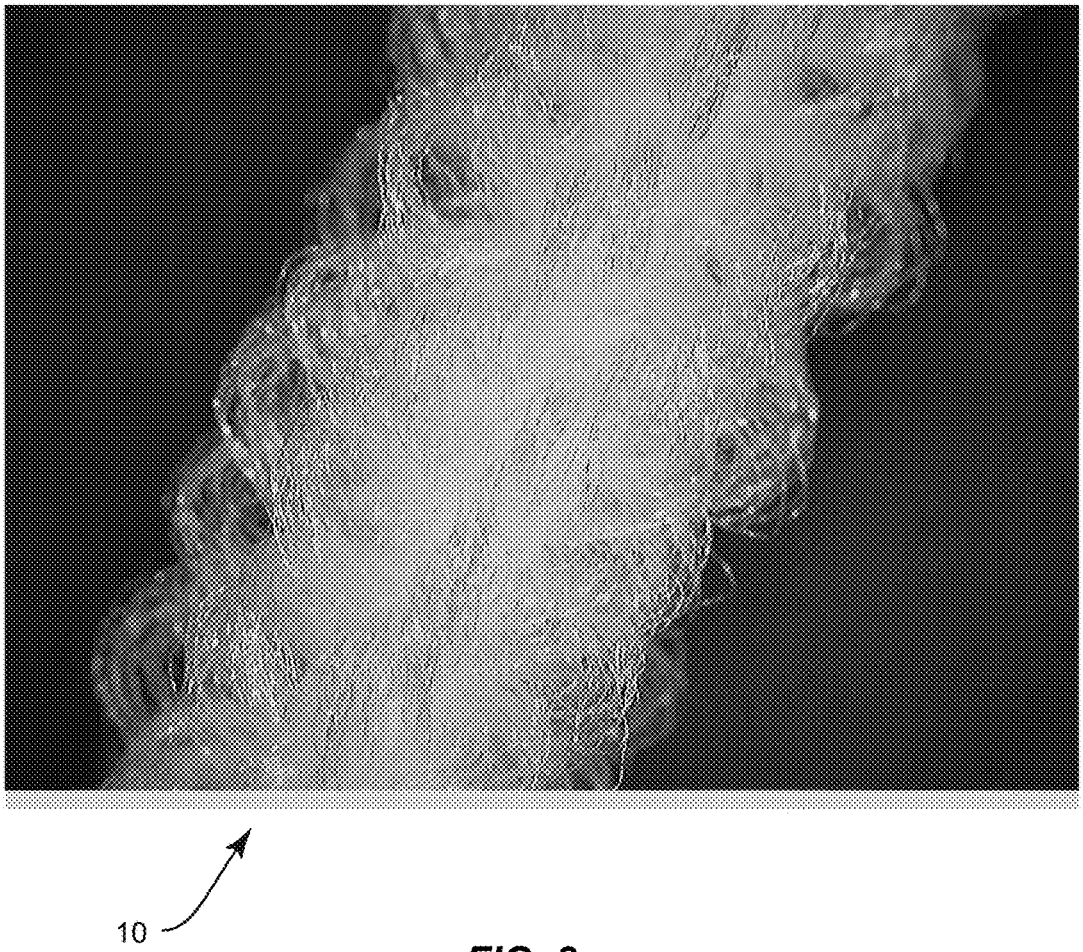
FIG. 2 is a magnified top view of a circular knit tubular textile for use as an ear loop according to an embodiment of the present disclosure.

FIG. 2 is a magnified photograph of a length of a textile 10 suitable for use as ear loops, also referred to herein as ear straps, for face masks 100 (see FIG. 1). The textile 10 may be specifically constructed to create a puffy, billowed, blossomed, and cushioning structure when the textile is in a relaxed state as shown in FIG. 2. The puffy structure provides an improvement in the hand and comfort of the textile 10 for use in contact with the back of the ears of a user. The puffy structure present in the relaxed state also provides the textile 10 with sufficient extra length of inelastic materials so that the textile 10 is able to achieve significant elongation, such as at least 250%, when the textile 10 is stretched along the length thereof.

Several features and elements within the present disclosure may be capable of being stretched or elongated when an outside force is applied. Many of those same features and elements may have some degree of resilience to recover back to, or near, an original length. Similarly, the term "relaxed" is used in several instances throughout the present disclosure. The term "relaxed" refers to the state or condition of an element after outside forces are removed. The relaxed state may be considered as the state of the relevant structure as it would be found simply laying upon a table. The term "relaxed" does not necessarily carry a temporal requirement. A yarn described as "relaxed" when in isolation may not have the same length or tension as the same yarn in a "relaxed" textile product. In other words the structure of the finished product may prevent a component thereof from returning to a fully relaxed state.

The textile 10 shown in FIG. 2 may be produced in extensive lengths prior to being cut into short segments for use in masks. The textile 10 is a circular knit fabric having been produced on a circular knitting machine. The textile 10 is constructed from both elastic yarn and generally inelastic yarn. Suitable elastic yarns may include: Lycra®, Spandex®, Elastane, etc. Suitable elastic yarns are generally monofilament, and may have a denier between about 20 and about 300, preferably between about 70 and about 200, and more preferably between about 90 and about 110. As used in conjunction with the denier, the term "about" is used to encompass the manufacturing variances created during various yarn making and packaging processes. The denier values provided may therefore refer to either tested denier, based on a sample of a lot, or may refer to advertised denier as marketed by a yarn supplier. Use of too light of an elastic yarn may not provide sufficient power to the textile 10 to contract after being stretched. Too heavy of an elastic yarn may become cost prohibitive.

The generally inelastic yarn may have spun fibers or comprise multifilament textured yarns. Suitable materials for the generally inelastic yarn include polyester, nylon, etc. Textured yarns, as used herein, are continuous filament yarns that are treated by folding, looping, coiling, twisting, crimpling, or the like. The inelastic yarn may have a denier of between about 40 and about 150, and preferably between about 70 and about 80. Again, denier values may be either tested denier or advertised denier. One skilled in the art will be able to identify an elastic yarn, and therefore will be able to know when a yarn is, conversely, inelastic. In one embodiment, elastic yarns may be those made of continuous-filament man-made yarns that are very tightly twisted, heat-set, and then untwisted, producing a spiral crimp and giving a springy character.

To be suitable for use as an ear loop 104 (FIG. 1), the textile 10 of the present disclosure is knit on small diameter circular knitting machines. As used herein, a small diameter circular knitting machine includes one or more knitting cylinder, also referred to as a needle cylinder, or simply a cylinder, that is less than or equal to 1 inch in diameter, preferably on a machine with a knitting cylinder of about ⅝ inches in diameter. The result is a textile 10 with a maximum relaxed width of less than about ¼ inches. As is known in the art, tubular knit fabrics leaving a circular knitting machine will tend to contract. In other words, the circumference of the relaxed finished product will be much smaller than the circumference of the cylinder. In most cases, tubular knit fabrics will be ovular or even substantially flat in profile when relaxed. As used herein, the maximum relaxed width of a tubular fabric would be measured when the fabric is finished. If the finished fabric lays flat, the relaxed width may be approximated as one-half of the circumference. Widths exceeding ¼ inches would be expected to be uncomfortable behind the ear of a user. Further, larger tubular fabrics may not result in the desired bulking effects, resulting in a substantially self-supporting cylinder shape, as may be present when knitting smaller textiles under the same conditions. Therefore, wider products produced in a manner similar to the textiles 10 of the present disclosure may not have the improved hand achieved with the embodiments of the present disclosure.

Figure 3:
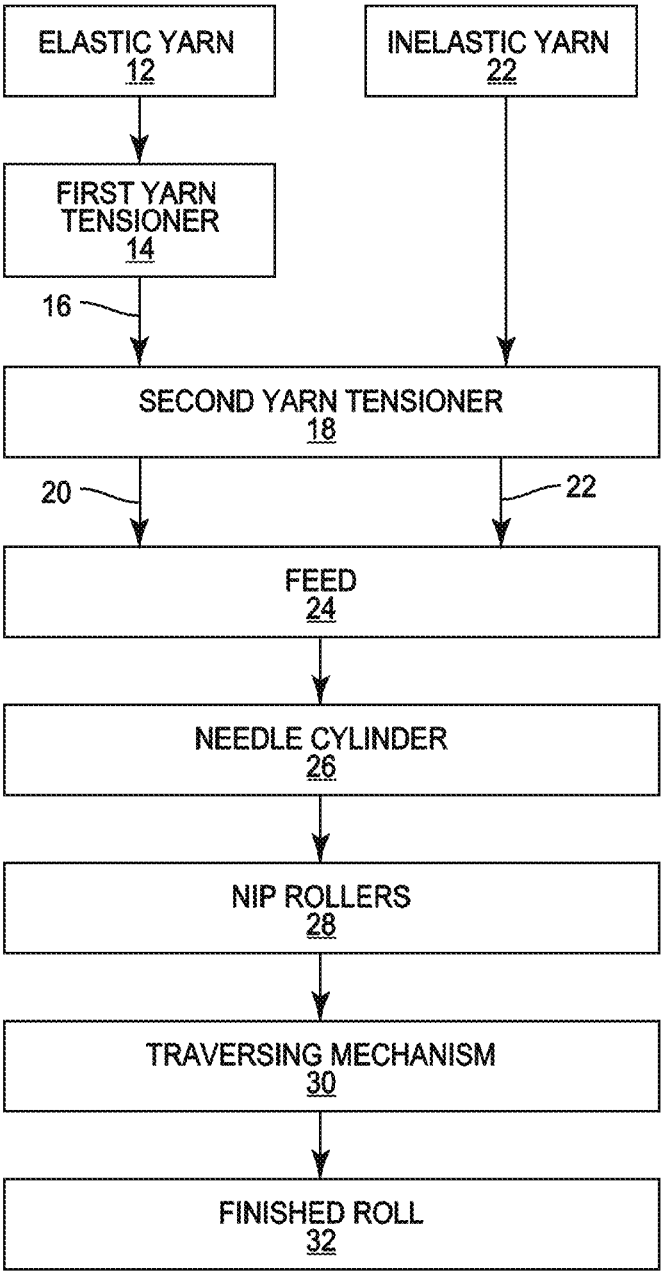
FIG. 3 is a process diagram for creating the circular knit tubular textile of FIG. 2.

FIG. 3 is a flow chart that shows one example of a process for forming the textile 10. Relaxed elastic yarn 12 is drawn from a first bobbin to a first yarn tensioner 14 at a first rate $R_R$, measured in length/time. The first yarn tensioner 14 stretches (e.g. elongates) the relaxed elastic yarn 12 to produce an intermediate elastic yarn 16, now traveling at a second, higher rate $R_1$. In one example the first yarn tensioner is an electronic Memminger Feeder set to at least about 4.5 cN, preferably at least about 5.8 cN and more preferably at least about 7.5 cN.

The intermediate elastic yarn 16 leaves the first tensioner 14 and is optionally fed to a second yarn tensioner 18, otherwise known as a positive feeder. Further tensioning forces are applied to the intermediate elastic yarn 16 to produce a stretched elastic yarn 20, now leaving the second yarn tensioner 18 at a third, potentially even higher rate of $R_S$. In one embodiment, $R_S$ is at least about twice as fast as $R_R$. In other words, the stretched elastic yarn 20 is stretched to at least twice the original relaxed (e.g. un-stretched) length of the relaxed elastic yarn 12 drawn from the first bobbin. In some embodiments, only a single tensioner acts on the elastic yarn.

Inelastic yarn 22 is drawn from a separate bobbin. In the illustrated embodiment, the inelastic yarn 22 is drawn with the second yarn tensioner 18. The tension applied to the inelastic yarn 22 by the second yarn tensioner 18 may minimize a ballooning effect as the inelastic yarn 22 is drawn from the bobbin, increasing the consistency of the textile 10. In other embodiments, the inelastic yarn 22 may be fed to the first yarn tensioner or directly to the feed of the circular knitting machine.

In the illustrated embodiment, both the stretched elastic yarn 20 and the inelastic yarn 22 leave the second tensioner 18 and may pass through the same feed 24. Thus, the length of inelastic yarn 22 passing though the feed 24 is substantially equal to the length of stretched elastic yarn 20 passing through the feed. Therefore, if the stretched elastic yarn 20 is at least twice as long as the relaxed elastic yarn 12, the length of inelastic yarn 22 is at least twice as long as the relaxed elastic yarn 12. In one embodiment the length of the inelastic yarn 22 is at least three times as long as the related elastic yarn 12.

The stretched elastic yarn 20 and the inelastic yarn 22 may be knit at a cylinder 26 with a jersey pattern. While both the stretched elastic yarn 20 and the inelastic yarn 22 are knit through a single feed 24, it should be understood that the stretched elastic yarn 20 and the inelastic yarn 22 remain substantially separate, having come from separate bobbins, as compared to the use of a covered elastic yarn, for example. Keeping the elastic and inelastic yarns separate from one another allows the yarns to take different configurations in their relaxed states. For example, when the elastic yarn contracts after knitting to a more linear configuration, the inelastic yarn is able to accordion into a more pillowed, wavelike, or bulky configuration. If the two yarn types were tied together in a coated elastic yarn, the configuration of the elastic portion and the inelastic portion would be forced to follow one another.

The resulting textile 10 may be pulled from the needle cylinder 26 using a pair of nip rollers 28. The textile 10 may then be led through a traversing mechanism 30 that moves the textile 10 back and forth along the length of a finished roll 32 for taking up the textile 10 into a package that is wider than the width of the textile. A suitable apparatus for the packaging the textile is disclosed by U.S. Pat. No. 6,381,993 commonly owned by Flynt Amtex, Inc of Burlington, N.C.

The process illustrated in FIG. 3 is one embodiment only. In other embodiments, the elastic yarn could bypass the second yarn tensioner. In other embodiments, the elastic yarn could engage the second yarn tensioner, and even a third yarn tensioner, separate from another tensioner provided for the inelastic yarn. In other embodiments, the inelastic yarn is provided directly to the feeder without being tensioned.

In some embodiments, the textile 10 may be knit using a multi-feed machine capable of knitting several courses per revolution of the cylinder. When a multi-feed circular knitting machine is used, the individual feeds may receive one or both of the inelastic yarn 22 and the stretched elastic yarn 20. In a multi-feed machine, elastic yarn does not have to be in all courses of the textile 10. Further, while a jersey knit pattern may be preferred, other knitting patterns may also be used within the scope of the present disclosure.

To provide the cushioned structure of the disclosed relaxed textile 10, the textile should be knit in a relatively loose pattern. The loose pattern provides clearance within the structure, i.e. sufficient space between adjacent loops, during knitting to be taken up by contraction of the relaxed elastic yarn 12 when the textile 10 is removed from the circular knitting machine. The textile 10 is configured such that when the textile 10 is relaxed, the elastic yarn will also relax back toward its original relaxed state. The more the elastic yarn is able to relax within the textile 10, the more bulky the relaxed textile is expected to be. The relatively loose knitting pattern is controlled by one or both of how closely-spaced the needles are for each course, and the stitch length.

Considering the first factor, needle spacing, a suitable ⅝ inch diameter needle cylinder may be constructed with 16 or more needles, resulting in a closely packed needle cylinder. Use of all 16 available needles would produce a relatively tight knit structure with respect to the circumferential direction. Inventors have found that the textile 10 should be knit from less than all of the 16 needles. The spacing of loops on the knitting cylinder may be expressed in terms of a ratio:

$$\frac{\text{Number of Needles Knitting}}{\text{Circumference of the Needle Cylinder}}$$

Prior products have been created with a ratio of $16/(\pi*0.625)=8.16$ stitches (needles)/inch. These prior products do not provide the distance between loops, while knitting, capable of providing the puffy textile 10 of the present disclosure when relaxed. Inventors have found that about 6 stitches/inch or less is preferred, and about 4 stitches/inch is more preferred. For a ⅝ inch diameter cylinder, this means using 12 or fewer needles, and preferably 8 needles.

Considering the second factor, the stitch length, the longer the stitch length, the more loose the knit structure of the textile 10 in an axial direction. The stitch length is the length of yarn used to create one needle loop plus half of the length of yarn between that needle loop and the adjacent needle loops on either side of the one needle loop. Therefore, the stitch length will correspond in part to the number of loops per course. Thus, knitting around the same circumference knitting cylinder with fewer needles results in a longer stitch length. Additionally, the stitch length will influence how closely packed the courses are to one another, where a long stitch length will mean the courses are further apart at the time of knitting.

A loose structure provides room for the inelastic yarn to pillow out as the elastic yarn constructs back toward its relaxed length after leaving the knitting cylinder. The pillows or waves of inelastic yarn then provide the extra length to be pulled straight when the textile 10 is stretched. The pillowed inelastic yarn provides the puffiness that enhances comfort, as well as the slack to enable significant elongation of the finished textile 10. On a circular knitting machine, the relative stitch length may be controlled by adjusting at least one of the feed rate of the yarn, in one instance by adjusting the take down speed, and the rotational speed of the needle cylinder. Therefore, the stitch length will increase as the feed rate is increased relative to the knitting rate. On the other hand, if the needle cylinder spins faster and yarn is added slower, there will be less yarn per loop, producing a smaller stitch length. Compared to the prior ear loop textiles, the textile 10 of some embodiments of the present disclosure is made with increased take down speed, to increase the stitch length, alternatively or in addition to the increase of stitch length provided by using fewer needles.

The fluffy cushioned end product may also be the result of feeding the stretched elastic yarn 20 into the circular knitting machine. When the textile 10 leaves the circular knitting machine, the stretched elastic yarn 20 will contract and force the inelastic yarn 22 to bunch or accordion together to generate the bulk of the textile 10. Because the stretched elastic yarn 20 and the inelastic yarn 22 pass through the same feed 24 during knitting, the length of inelastic yarn 22 per course and the length of stretched elastic yarn 20 should be considered substantially equal. However, because the elastic yarn is pre-stretched, and thus will be fed under higher tension (i.e. is elongated), the length of relaxed elastic yarn 12 per course is actually less than the length of inelastic yarn 22 per course. In one embodiment, each course, and therefore the textile 10 as a whole, may have between about three and about four inches of inelastic yarn 22 per inch of relaxed elastic yarn 12.

Figure 4:
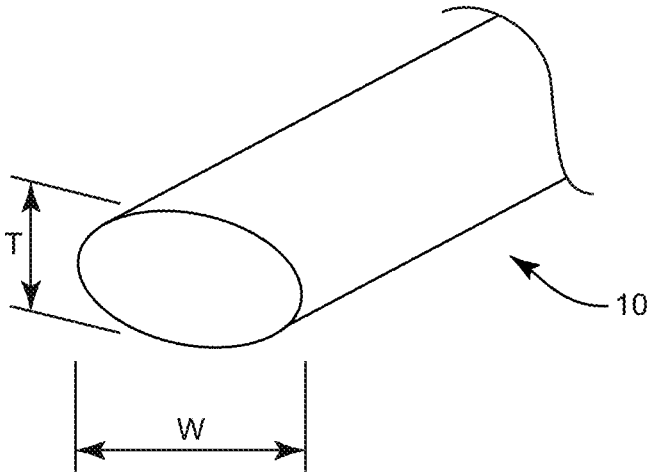
FIG. 4 is a schematic perspective end view of the tubular textile of FIG. 2.

The textile 10 of the present disclosure has been described as thicker, bulkier, puffier, more billowed, or more cushioned than other straps for ear loops 104. These adjectives may be quantified in terms of the relative profile shape of the textile 10 in a relaxed state. As shown in FIG. 4, the profile of the textile 10 may define a width W and a total thickness T. The total thickness T may be described as the height. In other words, as used herein, total thickness T means the thickness of the entire textile, and not the thickness per ply (i.e. a wall thickness of the tube). The relative bulk may then be described in terms of the ratio: T/W. This ratio would never exceed 1 because the width should be defined as the larger of the two dimensions. This ratio would be lower for textiles that lay flat after leaving the cylinder, and would be higher for bulkier textiles that maintain their cylindrical shape. Inventors have found that a ratio of at least about 0.5 is preferred, and a ratio of at least about 0.75 is more preferred.

Example

One suitable textile 10 (FIG. 2) was made with:

34 filament polyester yarn of 70 denier.

105 denier uncovered Lycra® initially tensioned with 7.5 grams of tension using an electronic Memminger feeder.

Both the polyester yarn and the Lycra® were run through a mechanical Memminger positive feeder to apply tension to each.

The yarns were then led to a single feed circular knitting machine with a ⅝ inch diameter knitting cylinder.

A jersey pattern was knit using every other of 16 available needles (half-gauging for 8 needles total). The Memminger feeder was set to approximately 850 RPM, the knitting cylinder was set to approximately 2050 RPM, and the take down rollers were set to about 32 RPM. The resulting textile had about 25% by weight of the Lycra® and about 75% by weight of the polyester yarn.

A package of continuous length textile 10 may be provided to separate manufacturers for cutting to appropriate length segments and affixing the ends of each segment to a suitable web 102 for forming a face mask 100. (FIG. 1)

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A circular knit fabric for face mask ear loops, comprising:

a circular knit tubular textile, comprising:

loops containing at least one inelastic yarn and at least one separate elastic yarn;

wherein the circular knit tubular textile has a maximum relaxed width of about ¼ inches;

wherein, in a relaxed state of the circular knit tubular textile, the at least one inelastic yarn has a length at least twice a length of the at least one elastic yarn; and wherein the circular knit tubular textile has less than 16 loops per course such that the circular knit tubular textile, when relaxed, produces a pillowed structure that provides increased comfort, and increased elongation when the circular knit tubular textile is stretched.

2. The fabric of claim 1, wherein the circular knit tubular textile has between 8 and 12 loops per course.

3. The fabric of claim 1, wherein the circular knit tubular textile comprises about 25% by weight of the at least one elastic yarn and about 75% by weight of the at least one inelastic yarn.

4. The fabric of claim 1, wherein the circular knit tubular textile comprises a jersey knit structure.

5. The fabric of claim 1, wherein the at least one elastic yarn is in a range of about 70 denier and about 120 denier; and wherein the at least one inelastic yarn is in a range of about 40 denier and about 150 denier.

6. The fabric of claim 1, wherein the at least one elastic yarn is in a range of about 90 and about 110 denier, and wherein the at least one inelastic yarn is in a range of about 70 and about 80 denier.

7. The fabric of claim 1, wherein, in a relaxed state, the circular knit tubular textile includes a range of about 3 inches and about 4 inches of the at least one inelastic yarn per inch of the at least one elastic yarn.

8. The fabric of claim 1, wherein the at least one inelastic yarn is selected from the group consisting of textured polyester or textured nylon.

9. A face mask, comprising:

a web configured to cover a nose and a mouth of a user, and a pair of ear loops attached to opposing sides of the web, each ear loop comprising:

a circular knit tubular textile, comprising:

loops containing at least one inelastic yarn and at least one elastic yarn, wherein the circular knit tubular textile has a maximum relaxed width of about ¼ inches, wherein, in a relaxed state of the circular knit tubular textile, the at least one inelastic yarn has a length at least twice a length of the at least one elastic yarn, and wherein the circular knit tubular textile has less than 16 loops per course such that the circular knit tubular textile, when relaxed, produces a pillowed structure that provides increased comfort, and increased elongation when the circular knit tubular textile is stretched.

10. The mask of claim 9, wherein the circular knit tubular textile has between 8 and 12 loops per course.

11. The mask of claim 9, wherein the circular knit tubular textile comprises about 25% by weight of the at least one elastic yarn and about 75% by weight of the at least one inelastic yarn.

12. The mask of claim 9, wherein the circular knit tubular textile comprises a jersey knit structure.

13. The mask of claim 9, wherein the at least one elastic yarn is in a range of about 70 denier and 120 denier; and wherein the at least one inelastic yarn is in a range of about 40 denier and about 150 denier.

14. The mask of claim 9, wherein the at least one elastic yarn is in a range of about 90 and about 110 denier; and wherein the at least one inelastic yarn is in a range of about 70 and about 80 denier.

15. The mask of claim 9, wherein, in a relaxed state, the circular knit tubular textile includes a range of about 3 inches and about 4 inches of the at least one inelastic yarn per inch of the at least one elastic yarn.

16. (The mask of claim 9, wherein the at least one inelastic yarn is selected from the group consisting of textured polyester or textured nylon.

17. A circular knit tubular textile, comprising:

at least one inelastic yarn and at least one separate elastic yarn, wherein the circular knit tubular textile has a maximum relaxed width of about ¼ inches, wherein, in a relaxed state of the circular knit tubular textile, the at least one inelastic yarn has a length at least twice a length of the at least one elastic yarn, and wherein the circular knit tubular textile has less than 16 loops per course.

18. The circular knit tubular textile of claim 17, wherein the circular knit tubular textile has between 8 and 12 loops per course.

19. The circular knit tubular textile of claim 17, wherein the circular knit tubular textile comprises about 25% by weight of the at least one elastic yarn and about 75% by weight of the at least one inelastic yarn.

20. The circular knit tubular textile of claim 17, wherein the circular knit tubular textile comprises a jersey knit structure.

21. The circular knit tubular textile of claim 17, wherein the at least one elastic yarn is in a range of about 70 denier and about 120 denier, and wherein the at least one inelastic yarn is in a range of about 40 denier and about 150 denier.

22. The circular knit tubular textile of claim 17, wherein the at least one elastic yarn is in a range of about 90 and about 110 denier, and wherein the at least one inelastic yarn is in a range of about 70 and about 80 denier.

23. The circular knit tubular textile of claim 17, wherein, in a relaxed state, the circular knit tubular textile includes a range of about 3 inches and about 4 inches of the at least one inelastic yarn per inch of the at least one elastic yarn.

* * * * *